US006109373A

United States Patent [19]

Able

[11] Patent Number: 6,109,373

[45] Date of Patent: Aug. 29, 2000

[54] CABLE OVERSHOT APPARATUS

[75] Inventor: Robert E. Able, Bozeman, Mont.

[73] Assignee: Boart Longyear International Holdings, Inc., Salt Lake City, Utah

[21] Appl. No.: 09/184,998

[22] Filed: Nov. 3, 1998

[51] Int. Cl.[7] ..... E21B 23/00; E21B 31/107

[52] U.S. Cl. ..... 175/293; 166/178

[58] Field of Search ..... 175/246, 293, 175/257; 166/178

[56] References Cited

U.S. PATENT DOCUMENTS

| | | | |
|---|---|---|---|
| 311,157 | 1/1885 | Wheeler | 175/293 |
| 335,493 | 2/1886 | Wheeler . | |
| 1,200,465 | 10/1916 | Bryson . | |
| 1,593,430 | 7/1926 | Bryson . | |
| 2,347,726 | 5/1944 | Auld et al. . | |
| 3,570,598 | 3/1971 | Johnson | 166/178 |
| 3,834,471 | 9/1974 | Bottoms | 166/178 |
| 4,061,389 | 12/1977 | Keller et al. . | |
| 5,327,982 | 7/1994 | Trahan et al. | 166/178 |

FOREIGN PATENT DOCUMENTS

| | | | |
|---|---|---|---|
| 531 305 | 10/1956 | Canada | 166/178 |

*Primary Examiner*—Thomas B. Will
*Assistant Examiner*—Meredith C. Petravick
*Attorney, Agent, or Firm*—Clayton R. Johnson

[57] ABSTRACT

The overshot apparatus includes a head subassembly coupleable to the overshot coupling device of an inner tube assembly, a jar subassembly having an outer swivel end portion for having a wire line attached thereto and a tubular member and a cable subassembly having an axially elongated cable, an axial outer cable mount mounted to the tubular member with the cable extended therethrough and into the tubular member and providing a jar head, and an axial inner cable mount providing a jar member mounting the cable to the head subassembly and having the jar head delivering hammering blows thereto. The cable is of a rigidity for being movable into the tubular member to permit the jar head moving delivering a hammering blow to the jar member and a spread apart position. The cable is of a flexibility that when the subassemblies are in a spread apart position and the overshot assembly is being lowered with an inner tube assembly coupled thereto, the cable is arcuately bendable as the inner tube assembly is moved from a vertical condition to a horizontal position on the ground with the central axes of the subassemblies extending less than about 135 degrees relative to one another.

14 Claims, 3 Drawing Sheets

FIG. 1C
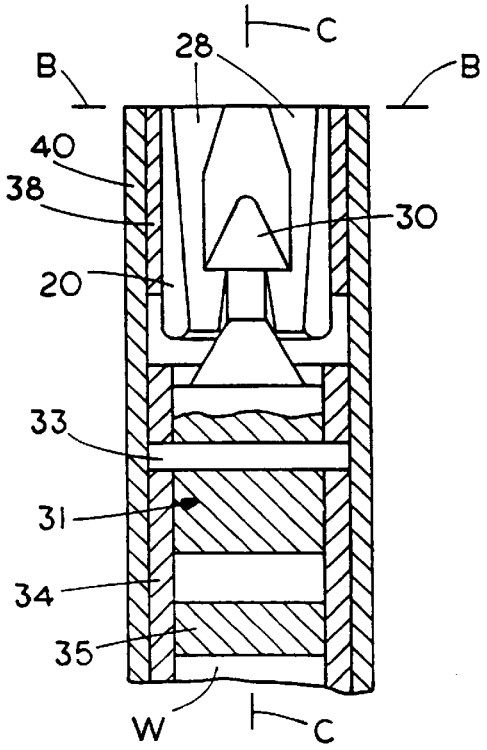
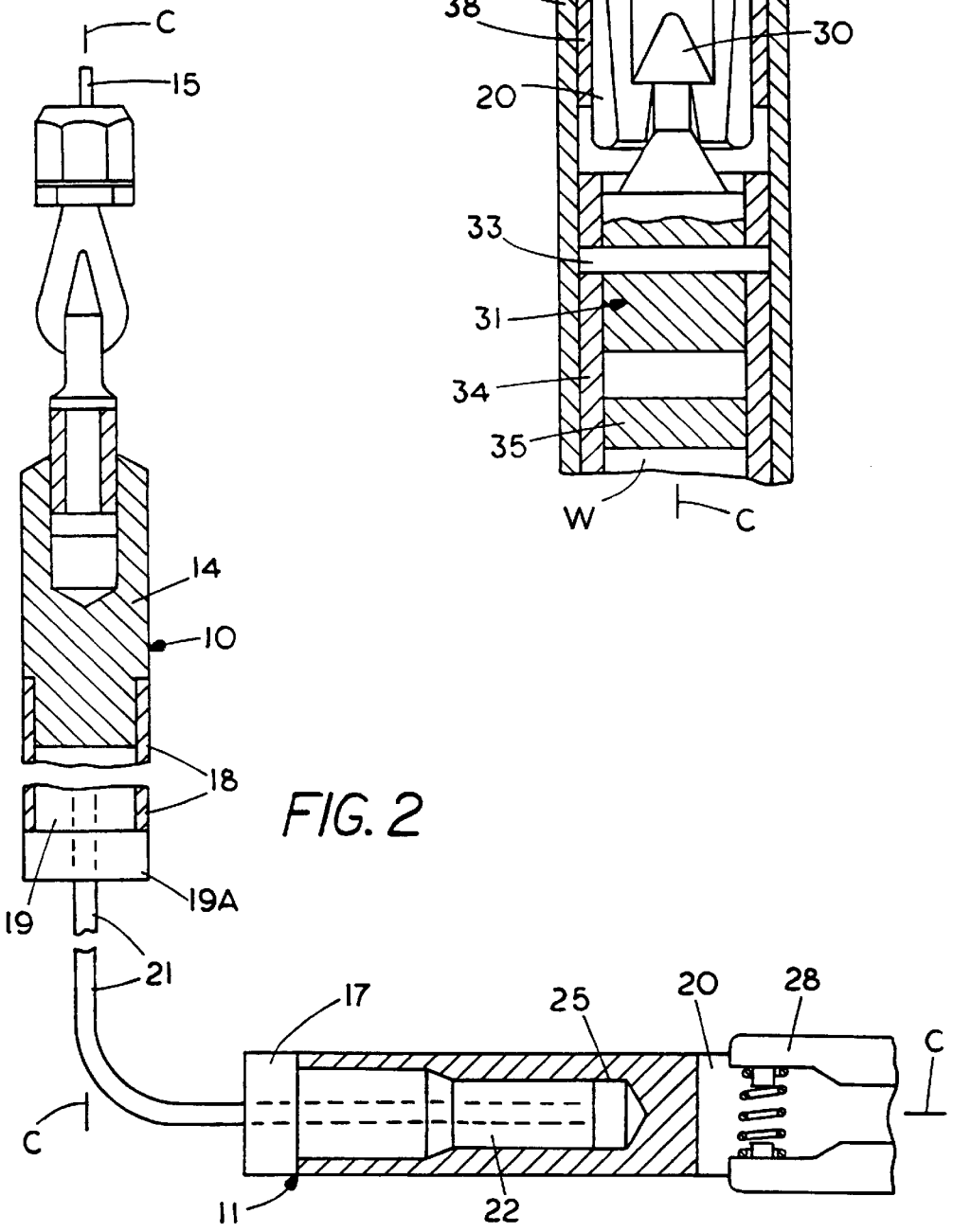
FIG. 2

CABLE OVERSHOT APPARATUS

BACKGROUND OF THE INVENTION

The present invention relates to drilling apparatus and more particularly to an overshot assembly for retracting and/or lowering drilling tools, including a core barrel inner tube assembly in a drill string.

Auld et al U.S. Pat. No. 2,347,726 discloses an overshot assembly having a jar head connected to the jaw assembly by jars. From the drawings it appears that one of the jars has an elongated slot into which the other jar extends. Bryson U.S. Pat. No. 1,593,430 discloses a drill jar piston that includes a piece of wire rope extending between the head and body portions. A metal sleeve surrounds the wire rope and abuts against the head and body portions to form a rigid spacer. It is further indicated that the drill jar piston is of a type shown in Bryson's earlier U.S. Pat. No. 1,200,465. Keller U.S. Pat. No. 4,061,389 discloses an overshot having a head portion connected by a jar to a knuckle joint which in turn is connected to a jaw assembly.

In using prior art overshot and core barrel inner tube assemblies, for example such as disclosed in U.S. Pat. No. 2,829,868 to Pickard et al, if the coupled assemblies are sufficiently elevated by the wire line to completely clear the drill string and the inner (lower) end of the inner tube assembly is then moved away from the drill string, as the coupled assemblies are lowered for laying the assemblies flat on the earth surface, at times conventional spearpoints such as disclosed in Pickard will pivot in the direction of the overshot dogs whereby the inner tube assembly becomes uncoupled and the outer end of the inner tube assembly falls. This can result in injury to the operator. Also, in using the above procedure with an overshot assembly such as disclosed in the patent to Pickard, at times, the jar staff bends or breaks whereby the jar staff has to be replaced. In an attempt to overcome such problems there was made a knuckle joint spearhead for core barrel inner tube assemblies, see U.S. Pat. No. 4,281,725 to Runk.

The knuckle joint core barrel inner tube assembly of Runk has been in use for many years. During that period of time, at times some problems have been encountered. If an adaptor sleeve is provided in surrounding relationship to the pulling dogs of an overshot assembly in order to adapt the overshot assembly for use in a larger inner diameter drill string than that with which the overshot assembly was originally intended to be used, in heavy drill mud, the rate of descent in a drill string is slower than without the sleeve. However, the sleeve is provided to help maintain the overshot assembly in a generally centered position in the drill string. Further, over a period of time, the spring in the knuckle joint device such as disclosed in Runk wears such that the point subassembly may tip in the drill string relative to the spear head base which makes it more difficult, if not impossible, for the overshot assembly to couple to the drilling tool that is to be retracted. Additionally, with the overshot and inner tube assemblies elevated out of the drill string, as the inner end of the inner tube assembly is manually moved during the step that the inner tube assembly is laid flat on the supporting surface, the transverse pivot axis of the knuckle joint is sufficiently angled relative to the supporting surface, the point subassembly and spear head base do not pivot relative to one another as intended. This can result in the jar rod being bent whereby it has to be replaced.

Further, in prior art overshot assemblies, the jar staff, which is provided to permit, in many situations, delivering hammering blows to facilitate coupling to an inner tube assembly and/or facilitate retracting the latches after the overshot assembly has coupled to the core barrel inner tube assembly, is the weak link and fails due to bending. Additionally, in the event that problems in the bore hole cause drill rods to twist off, it is easier to fish out an inner tube assembly that has a fixed spearhead (non-knuckle joint) as contrasted to one having a knuckle joint.

In order to make improvements in overshot apparatus to overcome problems such as the above, this invention has been made.

SUMMARY OF THE INVENTION

The overshot assembly is movable in a drill string to couple to the overshot coupling device of a wire line core barrel inner tube assembly or other types of drilling tools in a drill string and includes a jar subassembly that is connected to an overshot head subassembly by a cable subassembly. The jar subassembly is axially movable relative to the head subassembly for delivering hammering blows to the head subassembly. With the jar subassembly axially spaced from the head subassembly, the cable subassembly is arcuately bendable to permit the jar subassembly central axis being extendable relative to the head subassembly central axis from a position extending substantially coextensively to a position at an obtuse or right angle to extend at an angle up to, for example at least 135 to 90 degrees relative to one another when the overshot assembly moves a core barrel inner tube assembly outwardly of a drill string and the inner tube assembly is then laid flat on the ground as the overshot assembly is being lowered. Further, the cable subassembly cable is of a rigidity for permitting the jar subassembly to deliver hammering blows to the head subassembly.

One of the objects of this invention is to provide new and novel overshot means for retracting a drilling tool through a drill string. Another object of this invention is to provide in an overshot assembly, new and novel means for connecting a wire line to an overshot head subassembly. In furtherance of the last mentioned object, it is a further object of this invention to provide new and novel means as part of the connecting means for connecting jarring mechanism to the overshot head subassembly to permit the head subassembly being swung through an obtuse angle relative to the jarring mechanism.

For purposes of facilitating the description of the invention, the term "inner" refers to that portion of the drill string, or of the assembly, or an element of the assembly being described which in its position "for use" in, or on, the drill string is located closer to the drill bit on the drill string (or bottom of the hole being drilled) than any other portion of the apparatus being described, except where the term clearly refers to a transverse circumference, direction, or diameter of the drill string or other apparatus being described. The term "outer" refers to that portion of the drill string, or of the assembly, or an element of the assembly being described which in its position "for use" in, or on, the drill string is located axially more remote from the drill bit on the drill string (or bottom of the hole being drilled) than any other portion of the apparatus being described, except where the term clearly refers to a transverse circumference, direction, or diameter of the drill string or other apparatus being described.

As used herein, terminology such as "arcuately curved" or "arcuately bent" refers to the cable being curved or bowed along a portion of its length about a plurality of radii of curvature, all of which may be in a plane of the central axis along a substantial portion of the length of the cable, and the bending does not result in any significant permanent deformation of the cable even though the cable is so bent and straightened out a number of times. The arcuate curving or bending is of a nature that during use of the cable, the maximum bending may occur along one or more axial varying parts of the cable intermediate portion during a single elevating of the overshot assembly to, for example, raise the coupled overshot and inner tube assemblies from a substantially horizontal position to a vertical position, or lowering such coupled assemblies from a generally vertical condition to a position to have the inner tube assembly laid generally horizontal on a supporting surface. This is to be contrasted as to twisting of the cable about its central axis of elongation or bending of, for example, a conventional jar rod during use that would require replacement or repair to again make the overshot assembly usable for its intended purpose.

BRIEF DESCRIPTION OF THE DRAWINGS

FIGS. 1A–1C when arranged one above the other with the axial center lines aligned and lines A—A of FIGS. 1A and 1B aligned and lines B—B of FIGS. 1B and 1C aligned, form a composite longitudinal section through the drilling apparatus of the invention as the overshot assembly with an adaptor sleeve mounted thereto retracts a wire line core barrel inner tube assembly with the cable subassembly mounts in their maximum spread apart condition, only the outer end portion of the inner tube assembly being shown and axial intermediate portions of the jar tube and the cable being broken away;

FIG. 2 is a fragmentary longitudinal cross sectional view of the overshot assembly of FIGS. 1A–1C, other than no adaptor sleeve is mounted to the overshot body, with an axial intermediate portion of the cable broken away, said view showing the central axes of the overshot head subassembly and the overshot jar subassembly extending about 90 degrees relative to one another such as when a wire line core barrel inner tube assembly is laid flat and the head subassembly is still elevated after the overshot assembly has been withdrawn from a drill string;

DETAILED DESCRIPTION OF PREFERRED EMBODIMENTS

Figure 1A:
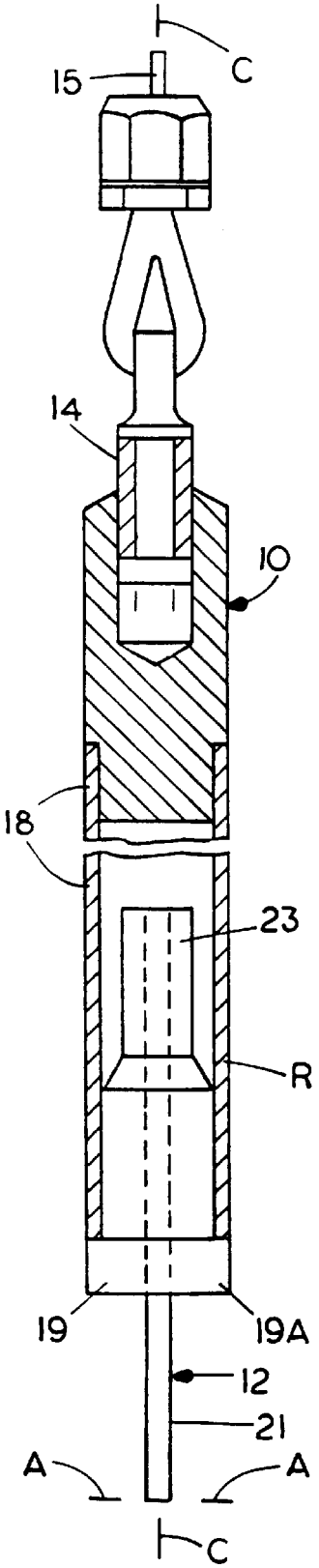
Figure 1B:
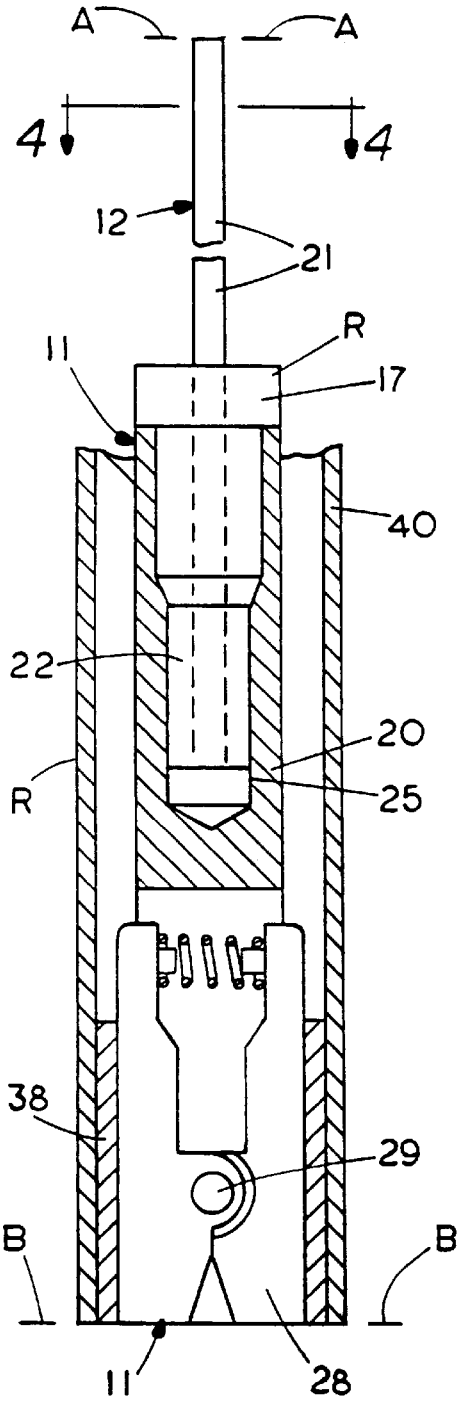
Figure 3:
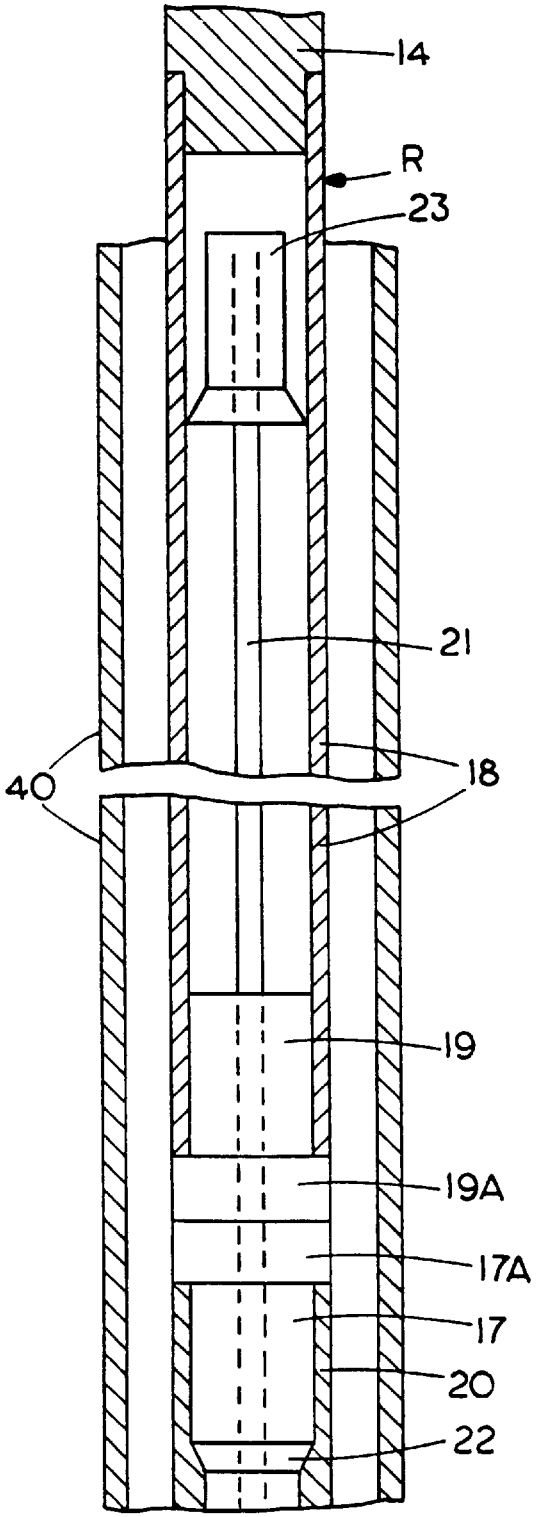
FIG. 3 is a fragmentary longitudinal cross sectional view showing the overshot jar subassembly delivering a hammering blow to the overshot head subassembly with an axial intermediate part of the cable broken away.
Figure 4:
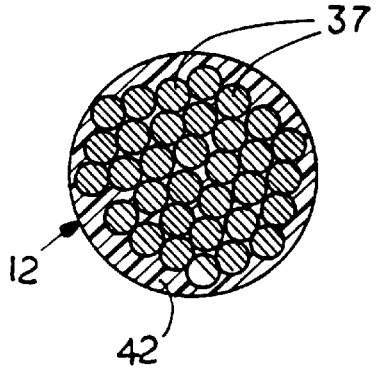
FIG. 4 is an enlarged transverse cross sectional view of the wire cable that is generally taken along the line and in the direction of the arrows of FIG. 1B.

Referring now in particular to FIGS. 1A–1C, there is illustrated an overshot assembly, generally designate R, that includes a jar subassembly 10 connected to a head subassembly 11 by a cable subassembly 12, each of which being generally designated. The jar subassembly 10 includes a swivel device 14 for connecting a wire line 15 to the outer end of the jar tube 18, the opposite end of the tube 18 being threadedly connected to a jar head (outer cable mount) 19 of the cable subassembly 12.

The cable subassembly also includes an inner jar member (cable mount) 17 threadedly connected to the outer end portion of the overshot body 20, which is part of the head subassembly. The cable subassembly also includes an axially elongated cable (wire rope) 21 axially slidably extended through the jar head and axially extended through the inner jar member. The axial length of the bore in the jar head through which the cable extends is of a length and forms a sufficiently close sliding fit that the central axis of the portion of the cable extending therethrough and the central axis of the jar subassembly are maintained so as not to be significantly out of coextensive alignment with one another.

The inner end of the cable has an inner botton 22 swaged thereto and extending within the axially opening bore 25 in the overshot body to abut against the inner end of the inner jar member for limiting axial outward movement of the cable relative to the inner jar member. Even though the inner end portion of the cable is slidably extended through the jar member 17, it may be axially fixed to the inner jar member. Advantageously the axial dimension of the bore is greater than the axial dimension of the inner part of the jar member that is threaded into the overshot body and the axial dimension of the inner botton by an amount that is less than the corresponding dimension of the inner botton.

A second (outer) botton 23 is swaged to the outer end of the cable for abutting against the outer end of the jar head to limit the axial inner movement of the cable relative to the jar head. Advantageously, the axial dimension of the cable intermediate portion that is axially between axial adjacent transverse surfaces of the jar head 19 and the jar member 17 when members 19 and 17 are in their maximum axial spaced positions is much greater than the combination of the axial dimensions of the buttons, the jar head and the jar member.

The inner end portion of the overshot body has an axially elongated, transverse slot in which a pair of pulling dogs 28 are pivotally mounted by a pivot member 29 for having their jaws coupling to the spearpoint 30 of the inner tube assembly coupling device, generally designated 31, of the wire line core barrel inner tube assembly W. The pulling dogs are resiliently urged to their coupling position such as shown in FIG. 1C by a spring 32 mounted to the outer end portions of the pulling dogs.

The coupling device 31 is mounted by a pin 33 in a substantially fixed axial position relative to the latch retractor tube 34 of the inner tube assembly such as shown in FIG. 1C. Alternately, the coupling device may be mounted to the latch retractor tube by having the pin extended through an axially elongated slot (not shown) such as shown in U.S. Pat. No. 3,333,647 to be mounted for limited axial movement relative to the latch retractor tube. In either event, no part of the coupling device is mounted for pivotal movement relative to the latch retractor 34 about a transverse axis in contrast to that such as disclosed in the above mentioned patent to Runk. The retractor tube is mounted to a latch body 35 in a conventional manner while the remainder of the inner tube assembly W, which is not shown, is of a conventional construction.

The cable is made of a plurality of twisted metal wire strands 37, preferably of stainless steel. Advantageously, a nonmetallic coating 42 may be provided to surround the combination of the plurality of strands to extend axially between the axially adjacent surfaces of the bottons, the coating being of a flexibility so as not to provide any substantial resistance to the arcuate bending of the cable while the jar subassembly is being elevated with the inner tube assembly coupled thereto initially laying flat on the ground preparatory to the inner tube assembly being inserted in the drill string 40, or the overshot assembly being lowered after being withdrawn from the drill string and the inner tube assembly being laid flat (having the inner tube assembly central axis extending generally horizontally) on the ground or other supporting surface while the jar subassembly is still in an elevated position above the supporting surface. The cable may be made in the form of wire strands bound together with an outer cover (coating) of flexible material such as plastic, for example may be Nylon, or wire strands woven together to form a single flexible coupling that couples the members 22, 23.

The diameter of the cable may be about 10–20 percent of the outer diameter of the jar head. As one example, the cable may be of a diameter of 7/16 or ½ inch. The length of the cable may be of the length of a conventional metal jar rod, for example about 12 inches (or greater) between the axially adjacent transverse surfaces of the jar head 19 and jar member 17 when the jar head and jar member are in their maximum spread apart condition such as shown in FIGS. 1A, 1B.

The cable, with or without a nonmetallic coating, is of a flexibility to permit being bent (arcuately curved or arcuately bent) that the central axis of the jar and head subassemblies extend through angles of 180 degrees to about 90 degrees without resulting in any significant permanent deformation. During the arcuate bending of the cable, along the length of the bent portion of the cable, the cable is axially bent through a plurality of the radii of curvature in the plane of the central axis of at least one of the jar and head subassemblies. Further, the cable is of a flexibility that it may be bent in any direction around the circumference of the cable. That is, the cable is arcuately bendable in an plane of the central axis of at least one of the head and jar subassemblies as contrasted to merely being twisted about the central axis of the cable. At the same time, the cable is of a rigidity that when the overshot assembly is in a drill string 40 and coupled to an inner tube assembly, the wire line may be retracted to axially space the jar head 19 from the jar member 17 such as shown in FIGS. 1A, 1B to their maximum axial spacing and upon releasing the retracting force on the wire line, the jar head will slide downwardly along the axial intermediate length of the cable to deliver a hammering blow to the inner jar member. With reference thereto, the axial length of the jar tube between the axial adjacent transverse ends of the swivel device and jar head 19 is greater than the length of the cable between the adjacent surfaces of the jar head and jar member when at their maximum linear spacing from one another plus the axial dimension of the outer botton 23.

Preferably, with the head and jar subassemblies in their spread apart condition, the adjacent terminal end surfaces of the jar head and jar member are transverse, perpendicular to the central axes when extending coextensively and parallel to one another. Further, the adjacent ends 19A and 17A of the jar head 19 and the jar member 17 form guide portions which are of transverse dimensions that are greater, or the same as, the maximum diameter parts of other parts of the overshot assemblies to maintain the overshot assembly in sufficiently centered relationship in the drill string to permit the pulling dogs coupling to the overshot coupling device.

If the overshot assembly R is to be used in a drill string that is a standard size larger than which assembly R is made for, an adaptor sleeve 38 is mounted to the overshot body in surrounding relationship thereto in a manner so as not to interfere with the overshot pulling dogs coupling to the inner tube assembly overshot coupling device. The adaptor sleeve serves to retain the head subassembly 11 in a sufficiently centered position in the drill string for the pulling dogs to pivot from an overshot device coupled position to their overshot device uncoupled position as they move axially inwardly over the spearpoint and thence to their overshot coupling device coupled position such as shown in FIG. 1C.

As an example, with the overshot assembly coupled to the overshot coupling device while laying flat on a supporting surface and the central axes of the overshot assemblies extending substantially coextensively in a straight line, if the jar and head subassemblies are not already in their maximum spread apart condition, these subassemblies will relatively move apart along the intermediate portion of the cable and the intermediate portion of the cable will start being progressively further arcuately bent with the included obtuse angle of the central axes of the jar and bead subassemblies becoming progressively smaller until the initial elevation of the head subassembly. Thence, further elevation results in the cable intermediate portion becoming decreasingly arcuately bent until the central axes of the jar, head and cable subassemblies are substantially coextensive (substantially extending, if not extending, in a straight line). When an inner tube assembly is retracted out of the drill string and the driller moves the inner end of the inner tube assembly preparatory to the overshot and inner tube assemblies laying horizontally on a supporting surface, the cable will arcuately bend such that the head and jar subassemblies will no longer extend coextensively.

It is to be understood that during both the elevating and lowering of the overshot assembly, the location of the arcuate bending along the axial length of the cable intermediate portion may vary and the arcuate bending may occur at two different axially spaced locations along the length of the cable intermediate portion. Additionally, it is to be understood that when the inner tube assembly is lowered to have its central axis extend horizontally, the jar subassembly does not have to be lowered to an extent that its central axis extends horizontally, but rather with the arcuate bending of the cable, the jar subassembly central axis may extend vertically. Further, it is to be understood that the inner tube assembly and head subassembly may be supported on a horizontal supporting surface with their central axes extending in a straight line parallel to the supporting surface while with the cable intermediate portion arcuately bent, the jar subassembly central axis may extend at an obtuse or a right angle relative thereto and parallel to the supporting surface.

Instead of the overshot coupling device of the inner tube assembly having an axial outer spearpoint, the inner tube assembly may have an axial outer, annular end portion with an annular transverse radially inwardly extending portion to form an axially inwardly facing shoulder and pulling dogs extendable into the annular portion and abuttable against the shoulder such as disclosed in U.S. Pat. No. 3,337,558 instead of pulling dogs such as shown in this application.

What is claimed is:

1. An overshot assembly that is movable axially inwardly in a drill string and retractable axially outwardly through the drill string by a wire line when applying a retracting force and being coupleable to an overshot coupling device of a drilling tool that is axially movable in the drill string, comprising an axially elongated overshot head subassembly having means for releaseably coupling to the overshot coupling device and an axially elongated opposite outer end portion, an axially elongated jar subassembly having an axially elongated inner end portion and axially opposite means for having the wire line connected thereto, at least one of the head subassembly outer end portion and the jar subassembly inner end portion having an axially elongated cable receptive tubular portion opening toward the other end portion of the respective one of the head subassembly and the jar subassembly each of the head subassembly and the jar subassembly having a central axis, and an elongated cable subassembly arcuately bendable through an angle that the central axes extend coextensively relative to one another, to one that the central axes extend at an included angle of about 135 to 90 degrees relative to one another and bendable back to extend at an angle that the central axes extend substantially coextensive relative to one another without any substantial permanent deformation, the cable subassembly including an axially elongated cable having a first end portion, a second end portion and an axially elongated intermediate portion extending between and joined to the cable first and second end portions, first cable mounting means for connecting one of cable end portions to the jar subassembly inner end portion, second cable mounting means for connecting the other of the cable end portions to the head subassembly outer end portion, means joined to the first cable end portion and abuttable against the adjacent cable mounting means to limit the movement of the cable in an axial direction toward the cable second end portion, means joined to the second cable end portion for limiting the movement of the cable in a direction toward the cable first end portion, one of the cable mounting means being mounted to the tubular portion and having the cable slidably extendable therethrough to have at least a major portion of the axial length of the cable, including the first cable end portion, extendable into the tubular portion to permit the jar subassembly being movable relative to the head subassembly between an axially spread apart first position and an adjacent abutting second position to deliver a hammering blow to the head subassembly, the cable being of a flexibility to permit the cable intermediate portion being repeatedly arcuately curved from a position the central axes extend at an angle of less than about 135 degrees relative to one another to a position the central axes extend substantially coextensive relative to one another and of a rigidity to permit the cable first end portion being reciprocated in the tubular portion upon the application of a vertical outwardly retracting force being applied to the jar subassembly and releasing the retracting force.

2. The overshot assembly of claim 1 wherein the overshot head assembly includes an overshot body having the said opposite end portion and a pulling dog slot and a pair of pulling dogs pivotally mounted to the overshot body and having axial inner jaws for releaseably coupling to the overshot coupling device.

3. The overshot assembly of claim 1 wherein the cable is a wire rope.

4. The overshot assembly of claim 1 wherein the second cable mounting means comprises a jar head mounted to the tubular portion to extend axially inwardly thereof and having the cable slidably extending therethrough and into the tubular portion.

5. The overshot assembly of claim 4 wherein the tubular portion is of a greater axial length than the cable intermediate portion.

6. The overshot assembly of claim 4 wherein the overshot head subassembly includes an overshot body having the said opposite outer end portion and the first cable mounting means comprises a jar member mounted to the overshot body end portion to extend outwardly thereof for receiving hammering blows from the jar head.

7. The overshot assembly of claim 6 wherein the overshot body includes a bore having the jaw member and the second cable end portion extended thereinto, the means joined to the cable second end portion extending within the bore inwardly of the jaw member.

8. An overshot assembly that is movable axially inwardly in a drill string and retractable axially outwardly through the drill string by a wire line when applying a retracting force and being coupleable to an overshot coupling device of a drilling tool that is axially movable in the drill string, comprising an axially elongated overshot head subassembly having means for releaseably coupling to the overshot coupling device and an axially outer end portion, an axially elongated jar subassembly having axially outer means for having the wire line connected thereto and a tubular member extending inwardly of said outer means and having an axially elongated tubular inner end portion, each of jar subassembly and the head subassembly having an axial central axis, and axially elongated, arcuately axially bendable cable means connecting the jar subassembly to the head subassembly for the jar subassembly being axially movable relative to the head subassembly from an axial spread apart position to a position delivering a hammering blow to the head subassembly and permitting the jar subassembly being repeatedly moved relative to the head subassembly between a position the central axes extend substantially coextensive relative to one another to a position that the central axes extend at an obtuse angle relative to one another of less than about 135 degrees, the cable means including an axial outer cable mounting member mounted to the tubular member, an axial inner cable mounting member mounted to the head subassembly, and an elongated cable extending between the cable mounting members when the subassemblies are in their spread apart position.

9. The overshot assembly of claim 8 wherein the cable means includes a wire rope.

10. The overshot assembly of claim 8 wherein the cable has an axial inner end, an axial outer end portion axially slidable through the outer cable mounting means and into the tubular member and, extended though the inner cable mounting means, means joined to the cable inner end and abuttable against the inner cable mounting means to limit the axial movement of the cable axially outwardly of the releaseably coupling means and means abuttable against the outer cable mounting means to limit the axial movement of the cable axially inward of the axial outer means.

11. An overshot assembly that is movable axially inwardly in a drill string and retractable axially outwardly through the drill string by a wire line when applying a retracting force and being coupleable to an overshot coupling device of a drilling tool that is axially movable in the drill string, comprising an axially elongated overshot head subassembly having means for releaseably coupling to the overshot coupling device and an axially outer end portion, an axially elongated jar subassembly having an axially elongate tube that has an axially elongated tubular inner end portion and axially outer means for having the wire line connected thereto, each of jar subassembly and the head subassembly having an axial central axis, and axially elongated, arcuately axially bendable cable means connecting the jar subassembly to the head subassembly for the jar subassembly being axially movable relative to the head subassembly from an axial spread apart position to a position delivering a hammering blow to the head subassembly and permitting the jar subassembly being repeatedly moved relative to the head subassembly between a position the central axes extend substantially coextensive relative to one another to a position that the central axes extend at an obtuse angle relative to one another of less than about 135 degrees, the cable means including an axially elongated cable portion movable extendable into the tube, and as the jar subassembly moves relative the head subassembly toward a position delivering a hammering blow, extends axially further into the tube.

12. The overshot assembly of claim 11 wherein the cable means includes a cable having a jar head mounted to the tube to have the cable axially slidably extended therethrough and limit the axial movement of the cable axially outwardly of the tube.

13. The overshot assembly of claim 12 wherein the cable portion is of a flexibility that when the said axial outer means is elevated from a position with the central axes extending generally horizontally and substantially coextensively, the cable is increasingly arcuately curved and then decreasingly arcuately curved, and of a rigidity that in the drill string with the head subassembly coupled to an overshot coupling device, the jar subassembly is reciprocally movable relative to the head subassembly between said spread apart position and the position for delivering hammering blows.

14. An overshot assembly that is movable axially inwardly in a drill string and retractable axially outwardly through a drill string by a wire line when applying a retracting force and being coupleable to an overshot coupling device of a drilling tool that is axially movable in the drill string, comprising an axially elongated overshot head subassembly having releaseably means for releaseably coupling to the overshot coupling device, an axially elongated jar subassembly having an axially elongated tubular inner end portion and axially opposite means for having the wire line connected thereto, each of the jar subassembly and the head subassembly having an axial center axis, and an axially elongated, arcuately bendable cable subassembly connecting the jar subassembly to the head subassembly for the jar subassembly being movable relative to the head subassembly from an axial spread apart position to a position delivering a hammering blow to the head subassembly and permitting the jaw subassembly being repeatedly moved from a position the central axes extend coextensively relative to one another to a position the central axes extend at an obtuse angle relative to one another of less than about 135 degrees, the cable subassembly having an end portion that is further axially slidably extended into the tubular inner end portion as the jar subassembly moves to deliver a hammering blow to the head subassembly and a cable intermediate portion of a flexibility that is repeatedly arcuately bendable through an angle that the central axes extend substantially coextensive relative to one another to an included angle the central axes extend at an included angle of about 135 to 90 degrees relative to one another when the subassemblies are in their spread apart position.

* * * * *